US005131609A

United States Patent [19]

Prouty

[11] Patent Number: 5,131,609

[45] Date of Patent: Jul. 21, 1992

[54] TWO-STRING STUNT KITE

[76] Inventor: Jonathan J. Prouty, P.O. Box 3065, Boulder, Colo. 80307

[21] Appl. No.: 716,619

[22] Filed: Jun. 19, 1991

[51] Int. Cl.[5] ..... B64C 31/06

[52] U.S. Cl. ..... 244/155 A; 244/153 R

[58] Field of Search ..... 244/153 R, 155 R, 155 A

[56] References Cited

U.S. PATENT DOCUMENTS

| | | | |
|---|---|---|---|
| 1,892,985 | 1/1933 | Hughes | 244/153 R |
| 2,203,150 | 6/1940 | Irvin | 244/153 R |
| 2,839,259 | 6/1958 | Mayne | 244/155 A |
| 3,615,064 | 10/1971 | Gellert . | |
| 4,286,762 | 9/1981 | Prouty | 244/153 R |
| 4,736,914 | 4/1988 | Tabor | 244/153 R |
| 4,781,345 | 11/1988 | Mileti | 244/155 R |
| 4,798,356 | 1/1989 | Alonso | 244/153 R |
| 4,871,133 | 10/1989 | Alonso | 244/153 R |
| 5,000,403 | 3/1991 | D'Alto | 244/155 A |
| 5,064,149 | 11/1991 | Prouty | 244/155 A |

FOREIGN PATENT DOCUMENTS 1515984 6/1978 United Kingdom .

OTHER PUBLICATIONS

Pelham, David, *Kites*, pp. 208–209, 1976.

"Kites", pp. 68–72 (Oriental Kites) copyright 1978.

*Primary Examiner*—Joseph F. Peters, Jr.

*Assistant Examiner*—Carla Mattix

*Attorney, Agent, or Firm*—Beveridge, DeGrandi & Weilacher

[57] ABSTRACT

A two-string stunt kite has a diamond shaped sail, a longitudinal keel strut, and a bowed cross strut disposed in a plane which is oblique to the keel strut. Left and right bridles are provided, each of which includes a first string attached to a forwared point on the keel strut, a second string attached to an aft point on the keel strut, and a third string which is attached to a point on the cross strut, inboard of the bridle's respective left and right wingtip.

17 Claims, 2 Drawing Sheets

TWO-STRING STUNT KITE

BACKGROUND OF THE INVENTION

This invention relates to a stunt kite which is controlled by two strings.

Many stunt kites are presently available which are controllable by two strings, whereby an operator can pull on one string or the other to cause the kite to perform a variety of maneuvers. Numerous configurations are available including kites which are diamond-shaped and delta-shaped.

Diamond shaped stunt kites fly primarily due to the "sled effect," i.e. the upward forces produced by the impact of the wind on the inclined downwardly-facing windward surface of the sail. These kites often have a cross strut with two halves which are connected to the keel strut by a rigid plastic fitting. The dimensions of the components are usually such that the sail is stretched and taut.

Some stunt kites such as the kite disclosed in the U.S. Pat. No. 4,286,762 have the so-called Rogallo shape in which the leading end of the keel strut is connected to two rearwardly swept wing struts so that, in flight, the sail forms two funnel shaped bodies. Each hemisphere acts as a foil which provides lift as it generates apparent wind speed in addition to the sled effect caused when the wind deflects off the lower surface of the funnel.

Single string stunt kites are also available. These kites, commonly called "fighters," were developed in Asia. They generally have a taut diamond-shaped sail, a longitudinal keel strut which extends from the nose to the tail, and a cross strut which extends from wingtip-to-wingtip. The cross strut normally lies in a plane which is parallel to the plane of the sail, and it is bowed in a direction which sweeps aft. A bridle is connected to an aft point on the keel strut, and to the point where the keel strut and the cross strut interconnect. It has been proposed in the prior art to use a wingtip-to-wingtip bowstring on a fighter kite. To control a fighter kite, the operator lets the control string go slack so that the kite becomes unstable and, when its nose is pointed in the desired direction, the string is pulled taut, so that wind forces push the cross strut into an oblique plane to drive the kite in a noseward direction.

The present invention has resulted from the discovery that, by combining known features of the fighter kites with known features of two string stunt kites, a new kite with characteristics superior to both is produced.

The kite of the present invention has many favorable attributes. It has a high strength-to-weight ratio, which makes it possible to manufacture it of relatively lightweight components. Due to its low mass, the impact of a crash will reduce the damage to the kite and to anything it strikes. The kite performs quite well in winds as low as two or three miles per hour, yet it performs well in higher winds up to 25 or 30 miles per hour. The kite is easily flown by a beginner, yet it is highly maneuverable in the hands of a skilled stunt kite operator. The kite also can be self-launched after a crash.

SUMMARY OF THE INVENTION

According to the invention, the kite has a diamond-shaped sail, a keel strut extending longitudinally from the nose to the tail end of the sail, and a cross strut which extends from the left wingtip to the right wingtip of the sail. The cross strut is attached to the keel strut at a connection point, and the cross strut is bowed to sweep aft from the connection point. The cross strut defines a plane which is oblique to the plane of the keel strut. A left bridle which is connectable to a control string includes three strings which are respectively connected to a point on the left portion of the cross strut, a forward point on the keel strut, and an aft point on the keel strut. A right bridle is connectable to another control string, and it is formed of three strings which are respectively connected to a point on the right portion of the cross strut, a forward point on the keel strut, and an aft point on the keel strut.

In lieu of the two three-string bridles, the bridle may include bridle strings associated with one or two triangular pieces of fabric which have an edge connected to the longitudinal centerline of the sail. In such an arrangement, the left bridle includes means for connecting a left control string to at least three points which include a left point on the cross strut, a forward point on the keel strut, and an aft point on the keel strut. The right bridle includes means for connecting a right control string to at least three points which include a right point on the cross strut, the forward point on the keel strut, and the aft point on the keel strut.

Preferably, the left point and the right point to which the bridles are connected are inboard of the wingtips of the sail. The cross strut is inserted in strut-receiving pockets at the wingtips. Sufficient excess material is provided in the sail so that it will form, aft of the cross strut in flight, a pair of downwardly open funnels having a draft which is about 5% to 35% of their width. The draft-to-chord ratio exists in a plane which (i) includes one wingtip and (ii) lies perpendicular to a line which bisects the angle formed by the keel strut and a tip-to-connection point line.

The cross strut is slidably connected to the keel strut at the strut-to-strut connection point, and the keel strut is provided with a stop member which limits forward movement of the connection point. The bridle arrangements are such that the forward points where the bridles are connected to the keel strut coincide with the connection point where the cross strut is connected to the keel strut. The points where the left bridle is connected to the keel strut coincide with the points where the right bridle is connected to the keel strut, and the bridle strings are looped around the cross strut and keel strut at their connection point.

According to another feature of the invention, a strut-receiving pocket is connected to a wingtip of the sail, a strut-receiving loop is located adjacent to the pocket, and a strut extends through the loop and into the pocket. A string has a loop which extends around the respective strut between the pocket and the loop in order to connect the string to a tip of the sail.

DETAILED DESCRIPTION

Figure 1:
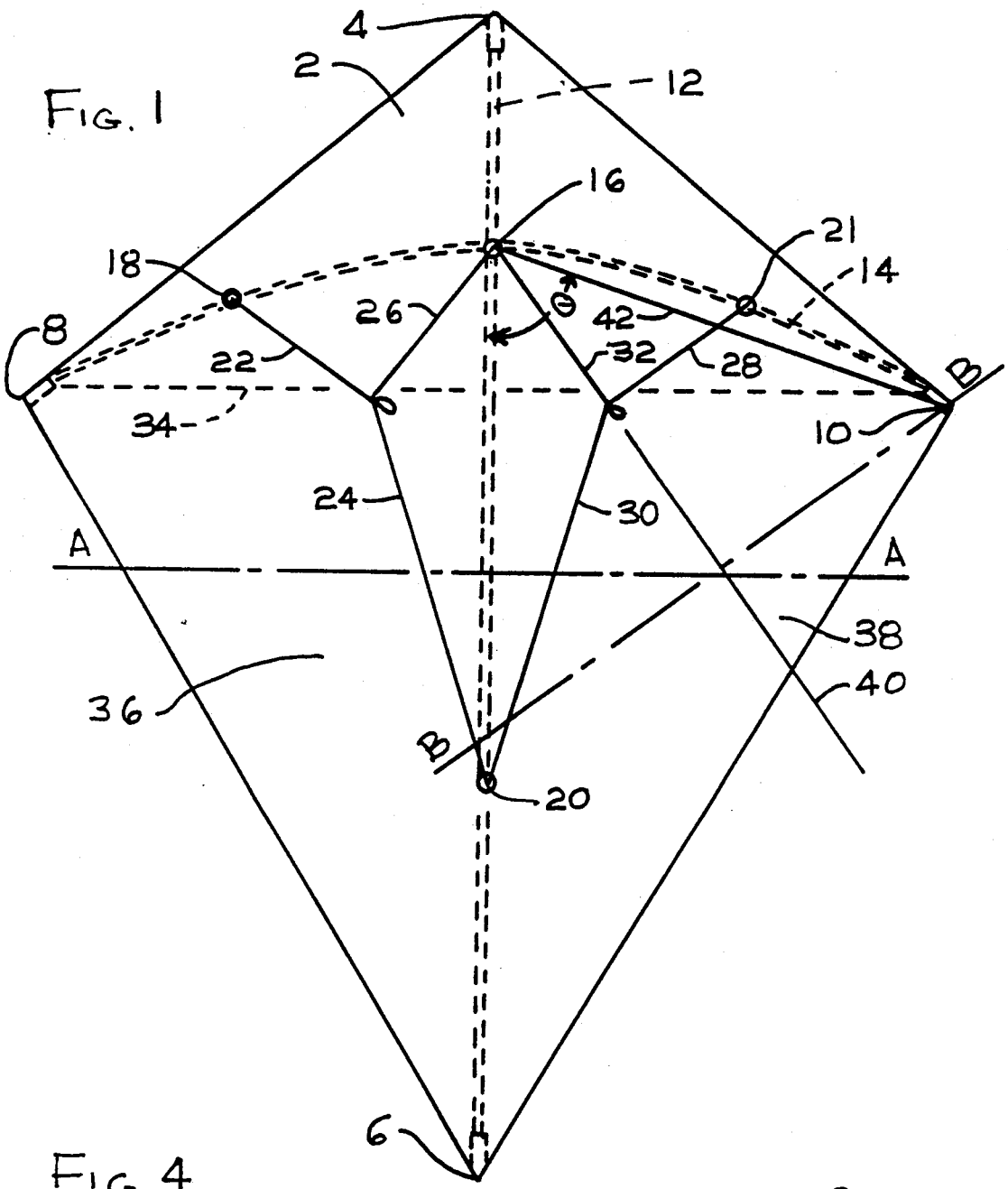
FIG. 1 is a view of the front face of the kite, which is its lower or w surface while in flight.

FIG. 1 is looking at the windward or lower surface of the sail 2 as it would be seen from the eyes of a person flying the kite. The sail 2 is a diamond-shaped piece of fabric or other sheet material having a nose 4, a tail end 6, a left wingtip 8 and a right wingtip 10. A keel strut 12 shown in broken lines extends longitudinally from the nose to the tail end of the kite, and a cross strut 14 extends from the left wingtip to the right wingtip. Strut-receiving pockets are provided at the four corners of the sail to receive the ends of the respective struts. One wingtip pocket can be sewn to the sail and the other may be provided with a closure of hook-and-pile material such as Velcro.

The cross strut 14 is slidably connected to the keel strut 12 at a connection point 16 and, as can be seen from FIG. 1, the cross strut 14 is bowed to sweep aft from the connection point 16 to the wingtips 8 and 10.

The cross strut 14 is stiffer than those normally used in fighter kites. Due to its stiffness, the cross strut resists any twisting or torquing which would distort it out of its defined plane and would tend to equalize the tension on the leading edges and the trailing edges of the sail.

When the kite is not exposed to the wind, the leading edges of the sail are taut and linear, whereas the trailing edges are sufficiently slack to form Rogallo funnels for optimum performance.

The sail 2 is provided with four grommets which permit connection of six bridle strings to four points 16, 18, 20 and 21 on the struts of the kite. The left bridle includes three strings 22, 24, and 26 which extend respectively from a left point 18 on the cross strut which is inboard of the left wingtip, an aft point 20 on the keel strut, and a forward point on the keel strut, the latter preferably coinciding with the strut-to-strut connection point 16. In a mirror image fashion, the right bridle includes three strings 28, 30, and 32 which extend respectively from a point 21 on the cross strut which is inboard of the right wingtip, the aft point 20 on the keel strut, and the forward point 16 on the keel strut.

Figure 2:
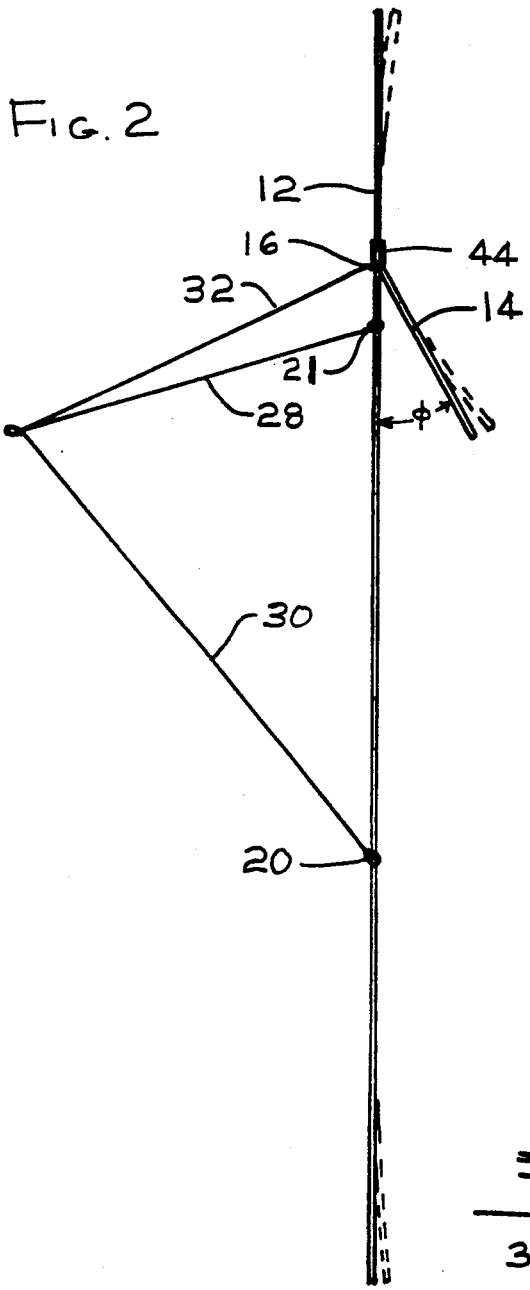
FIG. 2 a side view of the kite, wherein the sail has been omitted to reveal the skeletal and bridle arrangements.

The kite is bowed transversely by a bowstring 34 which extends from wingtip-to-wingtip as shown in broken lines in FIG. 1. When properly bowed, the inclination of the end of the cross strut 14 relative to the bowstring 34 is from about 5 degrees to about 45 degrees. This draws the cross strut bow to a position where its plane is oblique to the plane of the keel strut. Referring to FIG. 2, it will be seen that the keel strut plane and the cross strut plane are both perpendicular to the paper. The keel strut plane is parallel to a line from the left wingtip to the right wingtip, and the cross strut plane lies oblique to the keel strut plane at an angle $\Phi$.

Figure 4:
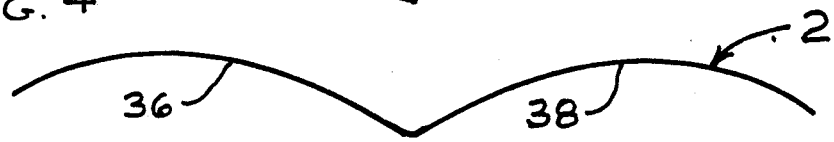
FIG. 4 is a diagram showing the shape of the sail in flight, in the plane A—A in FIG. 1.
Figure 5:
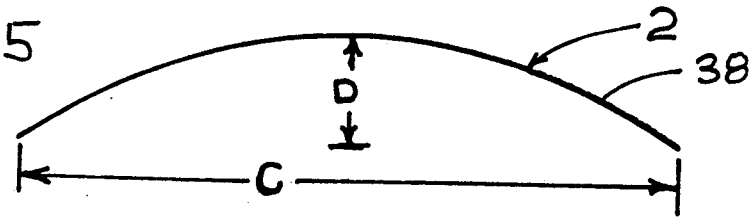
FIG. 5 is a diagram showing the shape of the sail in flight, in the plane B—B in FIG. 1.

The stiffness of the cross strut 14 and the size of the sail 2 are such that the sail has sufficient material to form, aft of the cross strut in flight, two downwardly open Rogallo funnels 36 and 38. The shapes of these funnels in the plane A—A in FIG. 1 is shown in FIG. 4, and a sectional view of one of these funnels 38 as seen along its central axis is shown in FIG. 5. The latter is seen in the plane B—B (FIG. 1). This plane (i) includes one wingtip 10, and (ii) lies perpendicular to a line 40 which bisects the angle (H) formed by the keel strut 12 and a line 42 which extends from the connection point 16 to the respective wingtip 10. In this plane, the curve of the sail 2 has a chord C and a draft D, and the benefits of this Rogallo funnel are realized when the ratio of the draft to the chord is about 5% to 35%.

Figure 3:
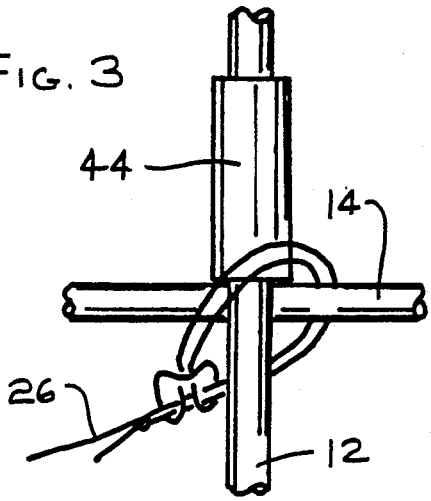
FIG. 3 is an enlarged view of the strut-to-strut connection point.

An important feature of the invention, illustrated in FIG. 3, is the provision of a stop means 44 on the keel strut 12 for limiting forward movement of the strut-to-strut connection. The stop means may take many forms. As illustrated, a piece of tubing 44 is glued to the keel strut to prevent the cross strut from moving forward beyond it. The bridle system and the reverse bowed cross strut 14 which is prevented by stop 44 from moving forward beyond a designated point provide the kite with a very strong tensioned frame in its core area.

In FIG. 3, it can also be seen that the bridle string 26 which extends through the sail is looped around the keel strut 12 and the cross strut 14 in order to connect the struts together. Bridle string 32 is similarly disposed, but it has been omitted from the drawing for clarity. Both are drawn taut to hold the struts 12 and 14 firmly together. Alternatively, the strut-to-strut connection can be made by various knots or even a supplemental member such as an 0-ring or a molded plastic fitting.

Rather than using bridles made entirely of string, the bridle arrangement may include one or two triangular pieces of fabric, sometimes referred to in the art as "keels," which have one edge thereof affixed to the longitudinal centerline of the sail 2. With such triangular pieces, the keel strut must be attached to the sail so that restraining forces from the bridle will be transmitted to the keel strut. If two triangular pieces are used their free apexes are connected to the strings 22 and 28. If a single triangular piece is used, its free apex is attached to outboard strings which extend from the points 18 and 21 to the apex. The left and right control strings are connected to loops formed in these outboard strings, spaced from the apex of the fabric piece.

In these alternative devices, fabric-and-string bridles connect control strings (i) to outboard (left and right) points on the cross strut, (ii) to a forward point on the keel strut, (iii) to an aft point on the keel strut, and (iv) along a continuous line which extends between the forward and aft points on the keel strut.

Figure 6:
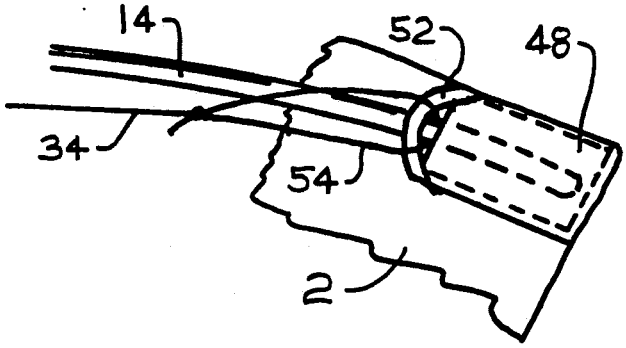
FIG. 6 is an enlarged view of a preferred configuration for connecting a bowstring to the strut-to-wingtip connection.

A simple structure for attaching the transverse bowstring 34 to a wingtip is shown in FIG. 6. Here, it will be seen that a piece of fabric is folded into a U-shape and sewn to the sail 2 to form a pocket 48 for receiving the end of the cross strut 14. A U-shaped loop 52 of material such as middy braid has its ends sewn to the sail, and this loop lies adjacent to the pocket. The tip of the cross strut 14 is inserted first through the loop 52 and then through a loop 54 formed in the bowstring 34 before it enters the mouth of the pocket 48, thereby connecting the bowstring to the wingtip. Alternatively, the ends of the bowstring may be permanently tied to middy braid loops at both wingtips.

In flight, the disclosed kite performs extremely well. The particular arrangement of struts and bridles provides an extremely strong core area defined by the points 16, 18, 20, and 21. In high winds, the portion of the keel strut 12 forward of the core area flexes as exaggeratedly shown by the broken lines in FIG. 2 to create a "upnose" condition which tends to stabilize the kite and provide a braking effect which slows it down to facilitate control by a beginner. Wind forces on the sail also tend to cause the outboard regions of the cross strut 14 and the aft region of the keel strut 12 to flex in a leeward direction as shown by broken lines in FIG. 2. This causes the Rogallo funnels to open up to spill air and depower the kite. A kite made of relatively light struts and a large sail area is able to fly quite well, even in heavy winds of 20 to 30 miles per hour.

Since the kite can be of lighter weight than other stunt kites with the same sail area, the kite is able to perform well in low winds, thus providing the kite with an extremely broad range of wind speeds in which it can perform effectively.

The Rogallo funnels give the kite forward drive, stability, tracking, sureness, and maneuverability. The kite is capable of turning sharp corners, it is able to fly very high in the sky, and also laterally to positions which are far left and far right of the wind direction.

The kite is easily assembled and disassembled. To fold the kite, the ends of the cross strut are removed from their respective pockets, the cross strut is rotated to a position parallel to the keel strut. The bridle strings will slide on the cross strut to allow this. The sail and struts are then rolled up into a light, compact body which is convenient to carry and store.

Persons familiar with the field of the invention will realize that it may take many forms other than those disclosed herein. Therefore, it is emphasized that the invention is not limited solely to the disclosed embodiment but is embracing of a variety of structures which fall within the spirit of the following claims.

I claim:

1. A stunt kite which is controllable by two control strings, comprising, a diamond-shaped sail having a nose, a tail end, a left wingtip and a right wingtip, a keel strut extending longitudinally from the nose to the tail end of the sail, said keel strut lying in a keel strut plane which is parallel to a line extending from the left wingtip to the right wingtip of the sail, a cross strut extending from the left wingtip to the right wingtip of the sail, said cross strut being attached to the keel strut at a connection point, said cross strut being in the form of a bow which sweeps aft from the connection point and defines a cross strut plane which is oblique to said keel strut plane, a left bridle which is connectable to a control string, said left bridle including three interconnected strings which are respectively connected to a left point on the cross strut, a forward point on the keel strut, and an aft point on the keel strut, and a right bridle which is connectable to another control string, said right bridle including three interconnected strings which are respectively connected to at least three points which include a right point on the cross strut, a forward point on the keel strut, and an aft point on the keel strut.

2. A stunt kite according to claim 1 wherein the bridles are connected to the cross strut at points which are inboard of the respective left and right wingtips of the sail.

3. A stunt kite according to claim 1 having strut-receiving pockets at the left and right wingtips of the sail, said cross strut being inserted in said pockets.

4. A stunt kite according to claim 1 wherein the cross strut is slidably connected to the keel strut at said connection point, said keel strut having a stop member thereon for limiting forward movement of said connection point.

5. A stunt kite according to claim 1 wherein the forward points where the bridles are connected to the keel strut coincide with the connection point where the cross strut is connected to the keel strut.

6. A stunt kite according to claim 5 wherein the bridle strings are looped around the cross strut and keel strut at their said connection point.

7. A stunt kite according to claim 1, wherein said points where the left bridle is connected to the keel strut coincide with said points where the right bridle is connected to the keel strut.

8. A stunt kite according to claim 1 wherein sufficient material is provided in the sail to form, aft of the cross strut in flight, downwardly open funnels having a draft which is about 5% to 35% of their width.

9. A stunt kite according to claim 1 wherein sufficient excess material is provided in the sail to form, aft of the cross strut in flight, two diverging downwardly open funnels, each said funnel having a draft-to-chord ratio of about 5 to 35 percent in a plane which (i) includes one wingtip, and (ii) lies perpendicular to a line which bisects the angle formed by (a) the keel strut and (b) a line from the respective wingtip to said connection point.

10. A stunt kite according to claim 1 having a strut-receiving pocket connected to a wingtip of the sail, a first loop attached to the sail adjacent to said pocket, one of said struts extending through said first loop and into said pocket, and a string having a second loop which extends around the respective strut between the pocket and the first loop to connect the string to a wingtip of the sail.

11. A kite having a keel strut, a cross strut, and a sail having at least one wingtip provided with a pocket, a first loop attached to the sail adjacent to said pocket, one of said struts having an end inserted through said first loop and into said pocket, and a string having a second loop which extends around the respective strut between the pocket and the first loop, whereby the string is connected to the respective wingtip of the sail.

12. A stunt kite which is controllable by two control strings, comprising, a diamond-shaped sail having a nose, a tail end, a left wingtip and a right wingtip, a keel strut extending longitudinally from the nose to the tail end of the sail, said keel strut lying in a keel strut plane which is parallel to a line extending from the left wingtip to the right wingtip of the sail, a cross strut extending from the left wingtip to the right wingtip of the sail, said cross strut being attached to the keel strut at a connection point, said cross strut being in the form of a bow which sweeps aft from the connection point and defines a cross strut plane which is oblique to said keel strut plane, a left bridle which is connectable to a control string, said left bridle including means for connecting a left control string to at least three points which include a left point on the cross strut, a forward point on the keel strut, and an aft point on the keel strut, and a right bridle which is connectable to another control string, said right bridle including means for connecting a right control string to at least three points which include a right point on the cross strut, a forward point on the keel strut, and an aft point on the keel strut.

13. A stunt kite according to claim 12 wherein the bridles are connected to the cross strut at points which are inboard of the respective left and right wingtips of the sail.

14. A stunt kite according to claim 12 wherein the cross strut is slidably connected to the keel strut at said connection point, said keel strut having a stop member thereon for limiting forward movement of said connection point.

15. A stunt kite according to claim 12 wherein the forward points where the bridles are connected to the keel strut coincide with the connection point where the cross strut is connected to the keel strut.

16. A stunt kite according to claim 12 wherein said points where the left bridle is connected to the keel strut coincide with said points where the right bridle is connected to the keel strut.

17. A stunt kite according to claim 12 wherein sufficient excess material is provided in the sail to form, aft of the cross strut in flight, two diverging downwardly open funnels, each said funnel having a draft-to-chord ratio of about 5 to 35 percent in a plane which (i) includes one wingtip, and (ii) lies perpendicular to a line which bisects the angle formed by (a) the keel strut and (b) a line from the respective wingtip to said connection point.

* * * * *